United States Patent [19]

Westover

[11] 4,456,193

[45] Jun. 26, 1984

[54] WEB ADVANCEMENT SENSING METHODS AND APPARATUS

[75] Inventor: Dwight G. Westover, Sierra Madre, Calif.

[73] Assignee: Bell & Howell Company, Chicago, Ill.

[21] Appl. No.: 302,866

[22] Filed: Sep. 16, 1981

[51] Int. Cl.[3] ..... B65H 28/18; B65H 17/26; B65H 25/04

[52] U.S. Cl. ..... 242/75.42; 242/67.3 R; 242/75.43; 242/75.44; 242/184; 242/189; 226/24; 226/44

[58] Field of Search ..... 242/57, 67.3, 75.43, 242/75.44, 184, 189, 190, 204, 75.42; 226/24, 25, 32, 44, 45, 120

[56] References Cited

U.S. PATENT DOCUMENTS

| | | | |
|---|---|---|---|
| 3,384,281 | 5/1968 | Mason | 226/25 |
| 3,432,020 | 3/1969 | Caudill et al. . | |
| 3,488,017 | 1/1970 | Schatteman . | |
| 3,511,451 | 5/1970 | Emmert . | |
| 3,558,069 | 1/1971 | Feder . | |
| 3,604,549 | 9/1971 | Caudill et al. . | |
| 3,627,228 | 12/1971 | Wolfe | 242/57 X |
| 3,762,530 | 10/1973 | Patel . | |
| 3,780,961 | 12/1973 | Kahwati et al. | 242/67.3 R |
| 3,837,462 | 9/1974 | Patel et al. . | |
| 3,889,795 | 6/1975 | Garberi et al. . | |
| 3,898,436 | 8/1975 | Pottebaum et al. | 242/75.51 X |
| 3,923,141 | 12/1975 | Hengelhaupt . | |
| 4,000,804 | 1/1977 | Zaltieri . | |
| 4,013,160 | 3/1977 | Colecchi et al. . | |
| 4,033,445 | 7/1977 | Oddicini . | |
| 4,111,378 | 9/1978 | Barwick . | |
| 4,111,565 | 9/1978 | Jagger . | |
| 4,159,807 | 7/1979 | Honsel et al. | 242/57 |
| 4,209,120 | 6/1980 | Ruegg et al. | 226/32 |
| 4,213,575 | 7/1980 | Firth et al. . | |

FOREIGN PATENT DOCUMENTS

| | | | |
|---|---|---|---|
| 41-47457 | 6/1966 | Japan | 242/75.44 |

*Primary Examiner*—Stuart S. Levy
*Assistant Examiner*—Lloyd D. Doigan
*Attorney, Agent, or Firm*—Benoit Law Corporation

[57] ABSTRACT

Methods and apparatus for sensing advancement of a web from a web supply remove the web from the supply in successive distinct and constant increments. Each constant increment is sensed upon its removal from the supply. Advancement of the web is then determined from the sensed constant increments. The requisite constant increments may be provided by advancing web from the supply and selectively arresting the supply to limit the advanced web to the constant increment for each advance.

9 Claims, 1 Drawing Figure

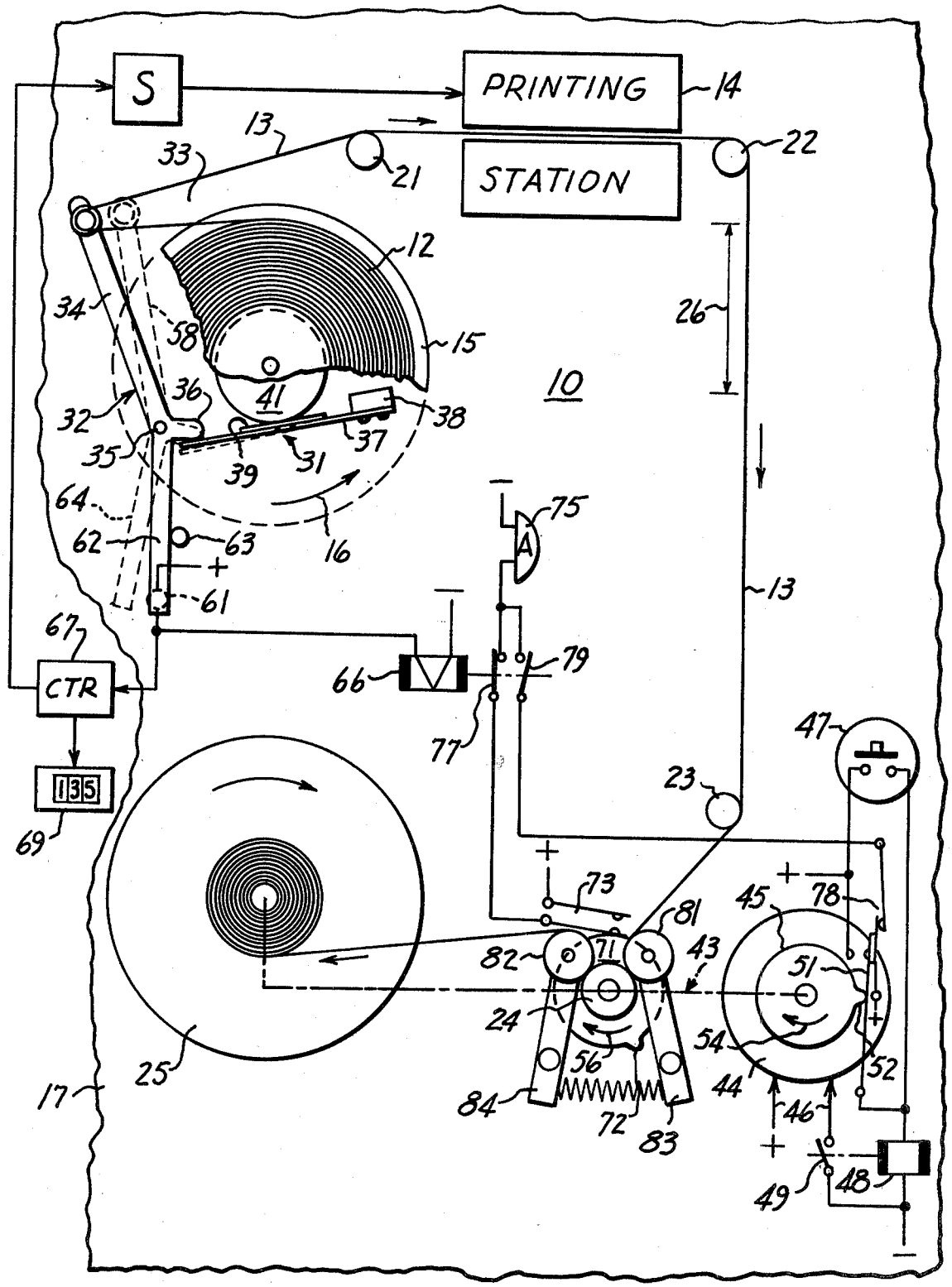
S
PRINTING
STATION
14
13
33
21
22
12
34
58
15
26
10
41
36
32
38
35
37
39
31
64
16
62
63
61
75
A
13
67
CTR
66
79
77
135
69
47
23
73
81
45
78
82
71
43
51
24
54
56
52
44
25
17
84
72
83
46
49
48

WEB ADVANCEMENT SENSING METHODS AND APPARATUS

BACKGROUND OF THE INVENTION

1. Field of the Invention

The subject invention relates to various kinds of web advancing methods and apparatus and, more specifically, to end-of-web sensors, equipment and techniques for determining a length of supplied web or a length of web remaining on a supply thereof, and other web handling systems.

By way of example, the subject invention is herein disclosed with emphasis on systems for supplying and advancing printing ink ribbons. It should, however, be understood that the subject invention applies broadly to magnetic recording and other tape supply and transport methods and apparatus, to paper, foil or film supply and advancing systems, and to various other kinds of web supply and advancing methods and apparatus.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

By way of example and not by way of limitation, reference may be had to U.S. Pat. No. 3,432,020 by A. H. Caudill et al, issued Mar. 11, 1969 and showing a small increment ribbon feed system employing a drag brake on a ribbon supply spool and a tension trap friction drag brake between a printing station and the takeup spool. The latter brake is driven via a ratchet mechanism and elastic transmission, and the friction drag brake is employed to control termination of the ribbon feed each cyle so as to achieve substantially constant ribbon advance increments.

Reference may also be had to U.S. Pat. No. 3,604,549, by A. H. Caudill, issued Sept. 14, 1971, and showing another ribbon feed mechanism for feeding a substantially constant linear or longitudinal amount of single pass ribbon past a printing position during each ribbon feed cycle.

On the other hand, the printing ribbon indexing system of U.S. Pat. No. 3,762,530, by R. U. Patel, issued Oct. 2, 1973, employs a printing hammer to increment the ribbon via rollers attached to the hammer and movable relative to corresponding stationary rollers. U.S. Pat. No. 3,837,462 by R. U. Patel, issued Sept. 24, 1974, employs a motor-driven takeup reel to supply tension to the ribbon system, a feed roll mounted on a one-way clutch, and a resiliently biased linkage actuated by operation of the print hammer for moving the ribbon a predetermined distance past the print station. U.S. Pat. No. 3,889,795, by S. Garbieri et al, issued June 17, 1975, employs special ribbon roll radius sensing for ribbon drive reversal purposes. U.S. Pat. No. 3,923,141, by Hans-Georg Hengelhaupt, issued Dec. 2, 1975, employs a transport roller for driving the periphery of a flange on a ribbon takeup spool, and decreases the angle of rotation of the transport roller as a function of takeup spool diameter to provide a substantially constant ribbon advance.

Reference may also be had to U.S. Pat. No. 4,000,804, by A. Zaltieri, issued Jan. 4, 1977, and showing an electric motor control for keeping a ribbon constantly taut during transfer thereof, U.S. Pat. No. 4,013,160, by P. S. Colecchi et al, issued Mar. 22, 1977, and showing a bifurcated leaf spring element in a ribbon tension device, and U.S. Pat. No. 4,033,445, by G. Oddicini, issued July 5, 1977 and employing ribbon spool size sensing levers for ribbon drive reversal purposes.

These and other ribbon or web advancing systems frequently suffer from a lack or insufficiency of information on the condition or length of ribbon advance or ribbon supply. Some other prior proposals have addressed themselves to aspects of that problem, but have had shortcomings of their own.

For instance, U.S. Pat. No. 3,448,017, by E. A. M. Schatteman, issued Jan. 6, 1970, discloses circuits for cutting off current from tape recorder components when a recording tape has been unreeled. To this end, that proposal, as well as a proposal according to U.S. Pat. No. 3,558,069, by C. Feder, issued Jan. 26, 1971, turns a rotary switch via a tape reel spindle, so that electronic sensing circuitry is periodically energized until the tape has run out. A mechanical approach which similarly turns a rotary switch via a tape spindle in order to prevent operation of a motor control switch during normal operation of the tape is apparent from U.S. Pat. 3,511,451, by R. Emmert, issued May 12, 1970. Proposals of this type appear to suffer from the drawback of widely varying pulse rates as a function of varying tape supply diameter.

Another proposal, apparent from U.S. Pat. No. 4,111,378, by M. L. Barwick, issued Sept. 5, 1978, folds the web material back upon itself towards the end of the ribbon supply, whereby a rotary web sensing system will reverse direction of rotation, indicating the impending tape end. The practicality of such a proposal is naturally limited by the ability to provide or obtain the requisite partially reversely wound web supplies. Similarly, a proposal according to U.S. Pat. No. 4,111,565, by B. E. Jagger, issued Sept. 5, 1978, requires provision of a special paper path with particular protrusions for sensing paper depletion in a printer.

A proposal according to U.S. Pat. No. 4,213,575, by R. V. D. Firth et al, issued July 22, 1980, requires a special and relatively complex hub structure for operation of an end-of-ribbon detecting system.

Against this background, there has persisted a need for web sensing advancement methods and apparatus which are not encumbered by the above mentioned drawbacks or inherent complexities.

SUMMARY OF THE INVENTION

It is a general object of this invention to overcome the disadvantages and to meet the needs expressed or implicit in the above disclosure statement or in other parts hereof.

It is a germane object of this invention to provide improved methods and apparatus for sensing advancement of a web from a web supply.

It is a related object of this invention to provide improved methods and apparatus for determining lengths of web removed from a supply and lengths of web remaining on a web supply.

It is also an object of this invention to provide improved methods and apparatus for sensing lack of advancement of a web derived from a web supply.

Other objects of this invention will become apparent in the further course of this disclosure.

From a first aspect thereof, the subject invention relates in methods and apparatus for sensing advancement of a web from a web supply, comprising, in combination, the steps of, or means for, removing the web from the supply in successive distinct constant increments, sensing each of these constant increments upon its removal from the supply, and determining from such sensed constant increments whether the web is advancing.

From another aspect thereof, the subject invention resides in apparatus for sensing advancement of a web from a web supply, comprising, in combination, means for forming web from the supply into a loop, means for inhibiting removal of web from the supply into the loop, means for pulling web from the loop thereby tightening the loop, means responsive to tightening of the loop for releasing the inhibiting means for a restoration of the loop, and means responsive to tightening of the loop for sensing advancement of the web.

BRIEF DESCRIPTION OF THE DRAWINGS

The subject invention and its various objects and aspects will become more readily apparent from the following detailed description of preferred embodiments thereof, illustrated by way of example in the accompanying drawing comprising a top view and somewhat diagrammatic showing of a ribbon or web supplying and sensing apparatus at a printing station according to a preferred embodiment of the subject invention.

DESCRIPTION OF PREFERRED EMBODIMENTS

The apparatus 10 shown in the drawing has a web or ribbon supply 12 from which a web or ribbon 13 is supplied to a printing station 14. By way of example, the web 13 may be an inked ribbon with the aid of which information is printed on sheets (not shown) at the printing station 14.

The ribbon supply 12 may be in the form of a spool located on a turntable 15 in force-transmitting relationship therewith, so that the turntable rotates in the direction of an arrow 16 when the ribbon 13 is pulled from the supply or coil 12. To this end, the turntable 15 is rotatably mounted on a baseplate 17.

The ribbon 13 proceeds along a ribbon supply path through the printing station 14 and via ribbon guides 21, 22 and 23 to a ribbon advance capstan 24 and hence to a ribbon takeup reel or turntable 25.

According to the subject invention, the ribbon 13 is removed from the supply 12 in successive distinct constant increments. By way of example, the drawing shows the length of such a constant increment at 26.

In the illustrated apparatus, the ribbon or web 13 is advanced from the supply 12, and such supply is selectively arrested to limit the advanced web to the constant increment 26 for each advance.

By way of example, the apparatus 10 has a brake 31 for the ribbon supply 12, and a device 32 for selectively releasing the brake for an advancement of ribbon from the supply, and for reapplying the brake to the supply to limit such advancement of the ribbon to the constant increment 26 for each advancement.

In particular, the illustrated device 32 forms ribbon from the supply 12 into a loop 33 and employs the brake 13 for inhibiting removal of ribbon from the supply 12 into such loop 33.

The illustrated device 32 comprises a compliance arm 34 pivoted for angular motion at 35. In this respect, the brake 31 and device 32 may, for instance, be located below the baseplate 17 or, as shown in the drawing, below the turntable 15.

The ribbon supply brake 31 is preferably actuated by the compliance arm 34, as shown in the drawing. To this end, the compliance arm has a projection 36 engaging the brake 31.

In particular, the brake has a leaf spring 37 mounted at one end on a post 38 projecting from the baseplate 17. A free end of the leaf spring 37 is engaged by the projection 36 of the compliance arm 34. The leaf spring 37 carries a brake lining 39 which engages a brake drum 41 when the compliance arm 34 is in its solidly illustrated relaxed position. The brake drum 41 is attached to or integral with the turntable 15 and is thus in force-transmitting braking relationship with the ribbon supply 12. The leaf spring 37 of the brake 31 biases the compliance arm 34 via projection 36 in the sense of a restoration of the loop 33 to its maximum size.

In the illustrated embodiment, a rotary ribbon or web drive 43 effects a predetermined angular web drive motion via capstan 24 for each pulling of web or ribbon 13 from the loop 33. In this respect, the capstan 24 is preferably driven "once around" by a ribbon driver motor 44 which also drives the takeup turntable 25, such as via a conventional slip clutch (not shown).

In particular, the motor 44 has a "once around" actuator 45 which automatically stops the motor 44 upon each revolution of the capstan 24. "Once around" drives are well known as such, but have been diagrammatically or symbolically shown in the drawing by way of example.

In particular, the motor 44 is of an electrically energized type, being started via supply leads 46 upon closure of a mechanical or electronic switch 47. This switch 47 may be a single-pulse generator which energizes a relay 48 or similar electronic component. Such relay or component 48 energizes the ribbon drive motor 44 via a contact or switch 49. A further switch 51 is in a self-holding circuit of the relay 48 and is actuated by the component 45 having a projecting cam or protrusion 52.

In particular, the cam device 45 is coupled to the motor 44 for rotation thereby. The cam protrusion 52 holds the switch 51 open so that there is no energization of the relay 48 and ribbon drive motor 44 in the absence of an actuation of the switch 47.

The relay 48 is energized when the switch 47 is actuated and, in turn, energizes the motor 44 via relay contact 49. The cam 45 thereupon starts to rotate in the direction of the arrow 54 and the cam protrusion 52 thereby leaves the switch 51. If the switch 47 is a pulse generator, it may provide a pulse of sufficient length to effect closure of the switch 51 by departure therefrom of the cam protrusion 52.

On the other hand, the relay 48 may have a certain conventional delay function for this purpose. At any rate, the switch 51 closes upon departure therefrom of the angularly movable cam protrusion, thereby holding the relay 48 and motor 44 energized beyond the opening of the switch 47. In this manner, the motor 44 drives the capstan 24 in the direction of an arrow 56, thereby pulling ribbon 13 from the loop 33. Since the brake 31 at that moment inhibits removal of ribbon from the supply 12, the loop 33 is tightened against the bias of the leaf spring 37.

In particular, when the rotating capstan 24 is pulling ribbon 13 from the loop 33, the compliance arm 34 is swung by the tightening loop as indicated by dotted lines 58. The compliance arm protrusion 36 thereby angularly moves against the bias of the brake spring 37, thereby lifting the brake pad 39 from the brake drum 41. This then permits the rotating capstan 24 to pull ribbon from the supply 12. The compliance arm 34 with brake-releasing projection 36 is thus responsive to tightening of the loop 33 for releasing the brake or inhibiting means 31 for a restoration of the loop 33.

In particular, the relaxed brake and its leaf spring 37 act to return the compliance arm 34 from its advanced position 58 to its solidly illustrated rest position 34 whereby the previously tightened loop is restored to its solidly illustrated condition.

The brake 31 is thereby reapplied to the brake drum 41, and effectively arrests the ribbon supply 12 to limit the advanced ribbon to the constant increment 26 at a time when the angularly movable cam projection 51 has completed one revolution, thereby reopening the switch 51. This thus opens the self-holding circuit of the relay 48, whereby energization of the motor 44 and rotation of the capstan 24 come to a stop. It is thus seen that the capstan 24 and accompanying components advance ribbon 13 from the supply 12, while the brake 31 and compliance arm device 32 selectively arrest the supply 12 to limit the advanced web to the constant increment 26 for each advance.

According to the invention, each of the constant increments 26 is sensed upon its removal from the supply 12. To this end, the illustrated embodiment has a photocell 61 which is maintained obscured by a shutter 62 connected to or integral with the compliance arm 34.

In the absence of a tightening of the loop 33, the brake spring 37 maintains the shutter 62 in its photocell-obscuring position via tension arm projection 36. Also, a stop 63 may be provided to prevent unintended exposure of the photocell in case of a breakage of the ribbon 13. The stop may be attached to the baseplate 17.

If thereafter the rotating capstan 24 pulls ribbon 13 from the loop 33 as described above, the tightening loop moves the compliance arm 34 to its advanced position 58 and thereby the shutter 62 to its corresponding advanced position illustrated by dotted lines 64. As seen in the drawing, the shutter 62 is a projection of the compliance arm.

The photocell 61 is thus exposed to light and emits a signal to a relay 66 and counter 67. The photocell 61 and shutter 62 cooperating therewith thus constitute a sensing means for issuing for each predetermined angular web drive motion a signal in response to tightening of the loop.

The photocell 61 or equivalent loop tightening sensor thus generated specific signals corresponding proportionately to the removed constant increments 26 when the ribbon supply is operating with a recurring "once around" revolution of the capstan 24 and intact ribbon 13. The counter 67 counts the signals issued by the photocell 61 and thus counts the sensed constant increments 26. The counter may thus determine from the sensed constant increments how much ribbon has been removed from any given supply 12. The counter 67 may comprise or actuate a visual numerical indicator 69 showing, for instance, the length of the removed ribbons in feet or other units of length.

On the other hand, the counter 67 may determine from the sensed constant increments or photocell signals a length of ribbon remaining on the supply 12. For instance, the counter 67 and its display 69 may be set for the total ribbon length when the ribbon supply is installed on the turntable 15, and may then count backwards toward zero as successive ribbon increments 26 are removed from the supply 12. In this manner, situations in which the ribbon 13 would run out in the course of a printing operation can effectively be prevented.

For instance, if a given printing operation is to consists of a certain run, it is very annoying and counterproductive having to stop the printing operation at some point during the run, just because the ribbon 13 has run out. By continually indicating the length of the ribbon still remaining in the supply, such annoying situations can be avoided. For instance, prior to starting a new run, the operator can ascertain from the counter display 69 where there is enough ribbon left in the machine to complete the contemplated printing run or operation. If the display 69 indicates that this is not the case, then the operator knows that it is time to replenish the ribbon supply 12 by a new roll. The same principle may, of course, be applied to various other kinds of web supply.

In many practical applications, it is also important to receive an immediate alarm or signal when the ribbon or other web 13 has broken or when the supply 12 has been exhausted. To accommodate this and similar requirements, the subject invention senses lack of advancement of the ribbon 13 from a cessation of sensed constant increments 26. Moreover, the illustrated embodiment contains means for indicating a lack of ribbon advancement upon failure of the photocell 61 or similar signal generating means to issue a signal during a predetermined angular web drive motion by the capstan 24.

To this end, the illustrated capstan 24 has a second cam 71 connected thereto. This cam 71 has a cam protrusion 72 which closes a pair of contacts 73 once during each revolution of the capstan 24.

In accordance with the illustrated embodiment of the subject invention, an alarm will sound or be generated at 75 if the photocell 61 fails to issue a ribbon increment signal during any one revolution of the capstan 24.

In particular, the photocell 61 energizes the relay 66 whenever the shutter 62 is removed therefrom in response to tightening of the loop 33 by the capstan 24. Accordingly, the normally closed relay contact 77 is open when the cam protrusion 72 closes the contact pair 73, whereby actuation of the alarm 75 is inhibited by the then open relay contact 77.

On the other hand, the photocell 61 remains obscured by the shutter 62 if the ribbon 13 has broken and is incapable of moving the compliance arm 34 to its advanced position 58. The relay 66 thus remains deenergized and the normally closed relay contact 77 remains closed. Accordingly, during the next revolution of the capstan 24, when the cam protrusion 72 closes the contact pair 73, the alarm 75 is energized and, depending on its nature, will either warn the operator or shut down the printing station or effect both of those measures.

Similarly, when the ribbon supply 12 is about exhausted, the ribbon 13, being for this reason and attached to the ribbon spool core, will be able to slide away from such spool core, so that the brake 31 will have no further effect on the ribbon 13. At that instant, the ribbon will no longer be able to move the compliance arm 34 to its advanced position 58.

The relay 66 will thus remain deenergized and the relay contact 77 closed, so that the alarm 75 will again be actuated when the cam protrusion 72 closes the contact pair 73 during revolution of the capstan 24.

If desired, ribbon supplies in which the end of the ribbon is attached to the ribbon spool core may easily be accommodated by the use of a circuitry which issues an alarm condition if the signal from the photocell 61 fails to terminate. By way of example, an extra contact 78 could be provided at the switch 51 and an extra contact 79 at the relay 66. The contact 78 is opened when the "once around" cam projection 52 leaves the switch 51. The relay contact 79 is closed when the shutter 62 moves away from the photocell. The contact 78 is reclosed when the cam protrusion 52 returns to its illustrated rest position after a revolution of the cam 45. At that time, the compliance arm 34 and shutter 62 would also have returned to their illustrated rest positions, if the ribbon advance is functioning properly. However, if the ribbon supply 12 is of a type in which the inner end of the ribbon 13 is attached to the supply core or spool and if the ribbon is at its end, or if the ribbon gets otherwise tangled so that it cannot advance, then the compliance arm 34 and shutter 62 cannot return to the photocell-obscuring position, so that the output signal of the photocell 61 persists, the relay 66 remains energized and its contact 79 closed, while the contact 78 recloses as mentioned above. The alarm 75 thus is energized via contacts 78 and 79.

Accordingly, if the compliance arm 34 and shutter 62 should remain in their advanced positions 58 and 64 at the end of a ribbon advance rotation by the capstan 24, an alarm would still be released, indicating that the ribbon supply is at an end. Alternatively, an alarm may be released if the photocell 61 emits a continuous signal instead of a pulse.

For a positive ribbon drive at the capstan 24, coupled with desirable compliance, nip rollers 81 and 82, individually mounted on spring-biased compliance arms 83 and 84, respectively, may be provided as shown in the accompanying drawings.

The subject extensive disclosure will suggest or render apparent to those skilled in the art various modifications and variations within the spirit and scope of the subject invention and equivalents thereof.

I claim:

1. Apparatus for sensing advancement of a web from a web supply, comprising in combination:

means including a compliance arm for forming web from the supply into a loop;

means for inhibiting removal of web from the supply into said loop, including a web supply brake having means for resiliently biasing said compliance arm in the sense of a restoration of said loop;

means for pulling web from said loop thereby tightening said loop and moving said compliance arm;

means on said compliance arm for releasing said brake for a restoration of said loop; and means including a projection of the compliance arm responsive to tightening of said loop for sensing advancement of said web.

2. Apparatus as claimed in claim 1, wherein:

said web pulling means include a rotary web drive effecting a predetermined angular web drive motion for each pulling of web from said loop; and said sensing means include means for issuing for each predetermined angular web drive motion a signal in response to tightening of said loop, and means for indicating a lack of web advancement upon failure of said issuing means to issue a signal during a predetermined angular web drive motion.

3. Apparatus as claimed in claim 1, wherein:

said web pulling means include means for removing said web from said supply in successive distinct constant increments;

said means for sensing advancement of said web include means for sensing each of said constant increments upon its removal from said supply; and said apparatus includes means connected to said sensing means for determining from the sensed constant increments whether said web is advancing.

4. Apparatus as claimed in claim 3, wherein:

said sensing means include means for generating specific signals proportionately to said removed constant increments; and said determining means include means for determining from said proportionately corresponding signals whether said web is advancing.

5. Apparatus as claimed in claim 3, wherein said removing means include:

means for advancing web from said supply; and means for selectively arresting said supply to limit the advanced web to said constant increment for each advance.

6. Apparatus as claimed in claim 3, including:

means for reapplying said brake to said web supply to limit said advancement of the web to said constant increment for each advancement.

7. Apparatus as claimed in claim 3, 5 or 6, wherein:

said determining means include means for counting said constant increments.

8. Apparatus as claimed in claim 3, 5 or 6, wherein:

said determining means include means for determining from said sensed constant increments a length of web remaining on said supply.

9. Apparatus as claimed in claim 3, 5 or 6, wherein:

said determining means include means for sensing lack of advancement of said web from a cessation of sensed constant increments.

* * * * *